US005272781A

United States Patent [19]

Bastin et al.

[11] Patent Number: 5,272,781

[45] Date of Patent: Dec. 28, 1993

[54] PROCESS AND A DEVICE FOR ELIMINATING LINT DEPOSITS IN HOT-AIR CIRCUITS OF CLOTHES WASHERS AND DRYERS

[75] Inventors: Paul Bastin, Taillette; Etienne Jafelin, Anchamps, both of France

[73] Assignee: Ardam SNC, France

[21] Appl. No.: 874,606

[22] Filed: Apr. 27, 1992

[30] Foreign Application Priority Data

Jul. 10, 1991 [FR] France ..... 91 08669

[51] Int. Cl.[5] ..... D06F 25/00

[52] U.S. Cl. ..... 8/158; 34/19; 68/20

[58] Field of Search ..... 34/86, 82, 19, 42; 8/158; 68/13 R, 12.09, 20, 27; 134/104.1

[56] References Cited

U.S. PATENT DOCUMENTS 3,083,557 4/1963 Decautur .
3,111,018 11/1963 Bonner .
4,434,564 3/1984 Braggins, Jr. ..... 34/86
4,640,344 2/1987 Pravda ..... 34/86 X
4,700,492 10/1987 Werner et al. ..... 34/82 X
4,794,661 1/1989 Durazzani ..... 8/158
5,050,259 9/1991 Tsubaki et al. ..... 8/159

FOREIGN PATENT DOCUMENTS 2646444 11/1990 France .

*Primary Examiner*—Frankie L. Stinson
*Attorney, Agent, or Firm*—Pearne, Gordon, McCoy & Granger

[57] ABSTRACT

The invention provides a process and a device for eliminating lint deposits in the hot-air circuit of clothe washers and dryers. The spiral backflow line (211) of the blower (210) and the air-heating chamber (230) are connected below by a line (220) which, along with the spiral backflow line (211) and the heating chamber (230), is filled with water up to a specific height (H) on the basis of the manometric backflow height (hm) of the blower so as to create a cyclical vortex effect that dislodges the lint deposits when the blower (210) is in operation.

3 Claims, 1 Drawing Sheet

PROCESS AND A DEVICE FOR ELIMINATING LINT DEPOSITS IN HOT-AIR CIRCUITS OF CLOTHES WASHERS AND DRYERS

Clothes washers and dryers, as well as the clothes dryers currently planned on the market, are generally equipped with a lint filter designed to trap a very large proportion of the fragments of textile fibers shed by the clothes as they dry, this is done to retard the formation of lint deposits in the dryer-air circuit to keep them from, for example, clogging passages and reducing the aerodynamics of the blower and the effectiveness of the sensors by "padding" their bulbs.

However,,these filters clog very quickly, which creates a very large loss of volume in the air line, requiring that the filter be cleaned with a special brush after each use, combined with the filter or a cross-current jet of air.

These solutions complicate the machine and require a deliberate manual operation after each use which, if not performed, risks compromising the results of the next drying operation, or even the operation of the machine itself.

There are machines not equipped with filters in which lint particles are deposited on the elements of the drying circuit during the wash cycles, particularly on the fan, the heating elements and the temperature controls, which causes a gradual decline in performance and risk of fire.

A washer and dryer are already known that have a lint filter that does not require cleaning or removal of accumulated lint (French patent application No. 2,646,444). The mesh filter lets small particles of lint pass through and its shape, which projects toward the inside of the drum,.promotes continuous contact with the laundry moving in the drum as it dries, which cleans the surface of the filter and keeps breaking up the lint caught in it. However, while this avoids the cleaning and the clogging of the filter, there are still lint deposits at certain points in the hot-air circuit, given the fact that humid air evacuated is recycled.

SUMMARY OF THE INVENTION

The present invention is aimed at correcting these drawbacks. The present invention, as it is characterized, solves the problem by defining a process and creating a device for using certain stages in the wash cycle of a washer and dryer to dislodge lint deposits, break them up and get rid of them, so that the hot-air circuit is free of them during the subsequent drying operation, with no manual intervention, by incorporating the lint-elimination operation(s) into the program that controls the operation of the machine.

The process of eliminating lint in the hot-air circuit of washers and dryers, according to the invention, is characterized mainly by the fact that the following operations are performed successively or simultaneously:

a) a level of liquid corresponding to the level in the washing/drying tub is gradually set in the hot-air circuit, b) the level of liquid is set above the level that totally fills the line connecting the blower air with the chamber for heating the dryer air, c) the blower is turned on and kept in operation for a time determined by experience, to dislodge and break up lint deposits, and to disperse them in the liquid temporarily kept in the hot-air circuit, d) the liquid and the suspended lint particles in the tub and the hot-air circuit are completely drained off, e) operations (a) to (d) above are performed at least once per wash cycle.

Preferably, the level of liquid in the hot-air circuit for totally filling the line connecting the blower backflow to the dryer air heating chamber is set at a specific height so that the difference in level compared to the upper wall of the communication line is a little below the manometric blower backflow height, so that the conditions exist to create and maintain a cyclical phenomenon of a vortex of water, from the blower backflow line to the heating chamber.

The device for implementing the process as explained below is characterized by the fact that the blower and its backflow line, on one hand, and the dryer air heating chamber, on the other hand, are located vertically and parallel to form the two sides of a U, and the line connecting the blower backflow line to the dryer air heating chamber forms the base, with the air intake and outtake at the ends of the legs.

The levels of liquid in the washing and drying tub and in the hot air circuit are brought into conformity by a line connecting the lowest point on the tub with that of the hot-air circuit.

The lint is eliminated by a drainage line connected to the lowest point of the line connecting the tub to the hot air.

According to one particular embodiment of the invention, the line connecting the washing/drying tub to the hot-air circuit can be cut off deliberately by a control valve located between the point where the drainage pipe is connected to the hot-air circuit; in this case, the valve is closed by a level detector in the hot-air circuit, controlled by the machine programmer.

The advantages gained from this invention basically include the fact that the lint produced during the previous drying operation is systematically eliminated during subsequent washing operations, with no user input and no need to add on expensive devices.

BRIEF DESCRIPTION OF THE DRAWINGS

Other characteristics and advantages will be apparent from the following description of a lint-elimination device made according to the invention for the needs of a washer and dryer, with air and water introduced by the drive shaft of the drum, as described In French patent application No. 9013819, given as a nonlimiting example, with regard to the appended drawings, in which.

DETAILED DESCRIPTION OF THE PREFERRED EMBODIMENT

Figure 1:
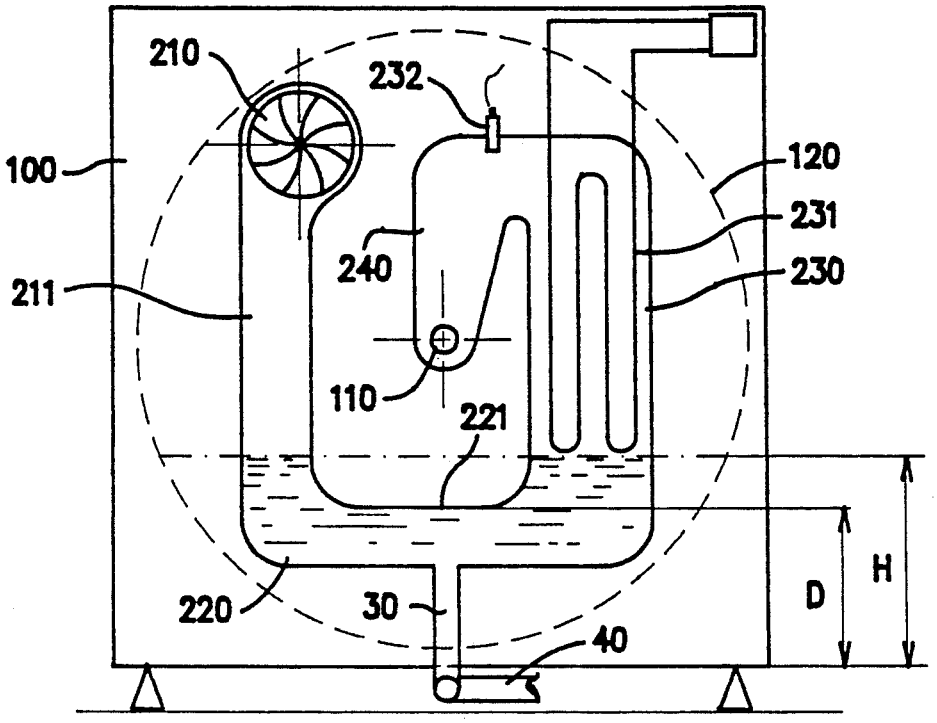
FIG. 1 shows a rear view, in cross section, of the circuit for producing hot air equipped with the lint-elimination device.

The drawings figures show a washer and dryer, with air and water introduced by the hollow drive shaft 110 of the drum 120 mounted in the tub 100, including, on the back, a double partition 200, containing a blower 210 with a spiral line 211 connected by a line 220 to a heating chamber 230 equipped with heating elements 231, a temperature sensor 232, powering, through a case 240, the hollow drive shaft 110 of the drum 120; the line 220 connecting the spiral line 211 of the blower 210 to the heating chamber 230 is connected by a line 30 to the tub 100, with a connection to the drainage lines 40.

Figure 2:
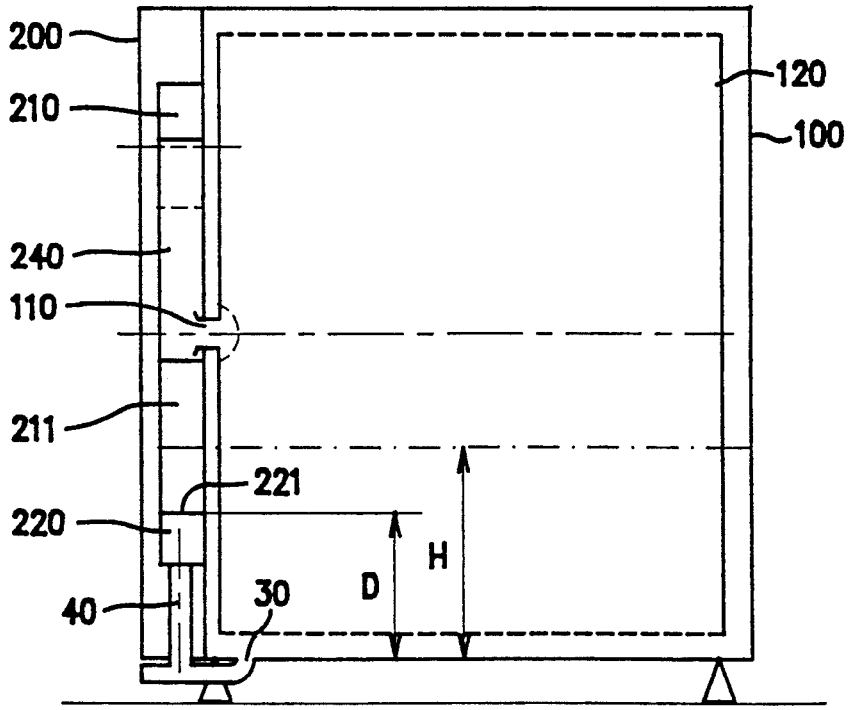
FIG. 2 shows a schematic view, in cross section, of the machine equipped with the lint-elimination device.

When one examines FIGS. 1 and 2 in greater detail, one can see that the tub 100 need only be filled up to a specific height (H) on the basis of the manometric height (hm) of the blower 210 and the drop (D) of the upper wall 221 of the line 220 in relation to the base of the tub 100, to produce, by the principle of communicating vessels, a corresponding level of liquid in the heating circuit located in the double partition 200.

Provided that the level has been set to have ($H-D<hm$), as soon as the blower 210 is put in operation, there is a blast of liquid contained in the heating circuit, from the spiral backflow line 211 to the heating chamber 230, accompanied by a vortex effect, as soon as some air arrives and goes along the upper wall 221 and out under the heating chamber 230, and inside near the entry of the case 240, projects some packets of liquid, which have a shock effect that dislodges and breaks up prior lint deposits. With the trap drained in this way, the liquid changes direction and, with some inertia, enters the spiral backflow line 211, where it is again pushed, according to the same process, and ultimately creates a cyclical phenomenon translating into repeated action on the toughest lint deposits, causing them to be completely eliminated, provided that the blower 210 stays on long enough.

Note that this operation can be carried out, in masked [sic]time, during drying, provided that the water in the last rinse bath has been trapped in the heating circuit by a control valve as soon as the level of water in the tub has fallen to the optimum level (H), as defined above. Then, with the blower on, the lint-elimination operation can be terminated at the same time as the drying operation, with the de-linting liquid then expelled at the same time as the water that is spun out of the laundry.

Obviously, therefore, the process and the device in the invention are not limited in this example of application to a front-loading machine, and they can be used on other washers and dryers, particularly top loaders, provided that the blower and the heating chamber are connected by a line and form a U where they each occupy the end of each leg, respectively.

We claim:

1. A process for eliminating lint in a hot-air circuit of a clothes washer and dryer, said washer and dryer including a washing/drying tub, a blower, a dryer air heating chamber, and a line connecting a spiral-backflow line of the blower to the heating chamber, comprising the steps of:

a) establishing a level of liquid in the hot-air circuit corresponding to a level of liquid existing in the washing/drying tub, the level of liquid in the hot-air circuit being above a level required for total filling of the line connecting the spiral backflow line of the blower to the dryer air heating chamber, b) starting the blower, c) running the blower for a time to dislodge and break up lint deposits and disperse them in the liquid held in the hot-air circuit, d) draining the liquid and lint particles from the tube and the hot-air circuit, e) performing operations (a) to (d) at least once per cycle of the clothes washer and dryer.

2. A process according to claim 1, wherein the level of liquid in the hot-air line for totally filling the line connecting the spiral backflow line of the blower to the dryer air heating chamber is established at a specific height (H) so that the difference between the liquid level in the hot air line and an upper wall of the connecting line is slightly below a manometric backflow height (hm) of the blower (210), meeting the conditions for creating and maintaining a cyclical water vortex phenomenon, from the blower (210) spiral backflow line (211) to the heating chamber (230).

3. A device for implementing the process according to claim 1, wherein the blower (210) and its spiral backflow line (211), on the one hand, and the dryer air heating chamber (230), on the other hand, are generally vertically oriented and parallel to each other, forming two legs of a U, and the line (220) connecting the spiral backflow line (211) of the blower (210) to the dryer air heating chamber (230 forms a base of the U, air being sucked in and expelled at ends of the legs, wherein the levels of liquid in the washer/dryer tub (100) and in the hot-air circuit are brought into conformity by means of a line (30) connecting a lowest point of the tube (100) to a lowest point of the hot-air circuit, lint being eliminated by means of a drainage tube (40) connected to a lowest point of the line (30) connecting the lowest point of the tube (100) to the lowest point of the hot-air circuit.

* * * * *

UNITED STATES PATENT AND TRADEMARK OFFICE

CERTIFICATE OF CORRECTION

PATENT NO. : 5,272,781

DATED : December 28, 1993

INVENTOR(S) : Paul Bastin, et al.

It is certified that error appears in the above-identified patent and that said Letters Patent is hereby corrected as shown below:

Col. 1, line 10, "dry," should read --dry;--.
Col. 1, line 15, "However,," should read --However,--.
Col. 1, line 36, "drum,." should read --drum,--.
Col. 2, line 48, "In" should read --in--.
Col. 4, line 14, "tube" should be --tub--.
Col. 4, line 37, "(230" should be --(230)--.
Col. 4, line 41, "tube" should be --tub--.
Col. 4, line 45, "tube" should be --tub--.

Signed and Sealed this

Twelfth Day of July, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,272,781
DATED : December 28, 1993
INVENTOR(S) : Paul Bastin et al It is certified that error appears in the above-indentified patent and that said Letters Patent is hereby corrected as shown below:

On the title page: Item [54]

[54], "PROCESS AND A DEVICE FOR ELIMINATING LINT DEPOSITS IN HOT-AIR CIRCUITS OF CLOTHES WASHERS AND DRYERS" should read --PROCESS AND DEVICE FOR ELIMINATION OF LINT DEPOSITS IN THE HOT-AIR CIRCUIT OF MACHINES FOR WASHING AND TRYING CLOTHES--.

Column 1, lines 2-4, "PROCESS AND A DEVICE FOR ELIMINATING LINT DEPOSITS IN HOT-AIR CIRCUITS OF CLOTHES WASHERS AND DRYERS" should read --PROCESS AND DEVICE FOR ELIMINATION OF LINT DEPOSITS IN THE HOT-AIR CIRCUIT OF MACHINES FOR WASHING AND DRYING CLOTHES--.

Column 1, line 5, insert "The invention concerns a process and a device for eliminating lint deposits in the hot-air circuits of clothes washers and dryers."

Signed and Sealed this

Twentieth Day of December, 1994

*Attest:*

BRUCE LEHMAN

*Attesting Officer*

*Commissioner of Patents and Trademarks*